US005156387A

United States Patent [19]

Seto

[11] Patent Number: 5,156,387

[45] Date of Patent: Oct. 20, 1992

[54] SUCTION CUP FOR SHEET FEED MECHANISM

[75] Inventor: Yoshihiro Seto, Minamiashigara, Japan

[73] Assignee: Fuji Photo Film Co., Ltd., Kanagawa, Japan

[21] Appl. No.: 597,477

[22] Filed: Oct. 10, 1990

[30] Foreign Application Priority Data

Oct. 16, 1989 [JP] Japan ..... 1-269804

[51] Int. Cl.[5] ..... B65H 3/08

[52] U.S. Cl. ..... 271/20; 271/106; 294/64.1

[58] Field of Search ..... 294/64.1; 271/20, 90–92, 271/106

[56] References Cited

U.S. PATENT DOCUMENTS

| | | | |
|---|---|---|---|
| 696,186 | 3/1902 | Orloff | 271/106 X |
| 3,3362,706 | 1/1968 | Busse | 271/106 X |
| 4,511,387 | 4/1985 | Kellar | 294/64.1 X |
| 4,661,139 | 4/1987 | Reese | 294/64.1 X |

FOREIGN PATENT DOCUMENTS

| | | | |
|---|---|---|---|
| 510886 | 10/1953 | Belgium | 294/64.1 |
| 47-32571 | 11/1972 | Japan . | |
| 11467 | 2/1978 | Japan | 271/106 |
| 55-52822 | 4/1980 | Japan . | |
| 234534 | 3/1990 | Japan . | |

*Primary Examiner*—Richard A. Schacher

*Attorney, Agent, or Firm*—Sughrue, Mion, Zinn, Macpeak & Seas

[57] ABSTRACT

A sheet feed mechanism for attracting and feeding stacked sheet-like members such as photographic films, one by one from a magazine, has a suction cup for developing a vacuum to attract the sheet-like members under suction. The suction cup comprises a base body including a panel member having an opening extending from one surface to another surface thereof, the opening being adapted to be connected to a vacuum source. The base body further includes a peripheral wall, joined to the other surface of the panel member and having wavy edges. The suction cup has a flexible suction skirt attached to and extending from the wavy edges of the peripheral wall, the flexible suction skirt being pressable against a sheet-like member.

12 Claims, 4 Drawing Sheets

SUCTION CUP FOR SHEET FEED MECHANISM

BACKGROUND OF THE INVENTION

1. Field of the Invention

The present invention relates to a suction cup for a sheet feed mechanism for feeding stacked sheet-like members such as photographic films one by one.

2. Prior Art

Recently, there have widely been employed image recording apparatus in which image information produced by a computerized tomographic system or the like is displayed on a CRT display unit, and the displayed image information is recorded on a photographic light-sensitive medium such as a photographic film and thereafter developed into a visible image for medical diagnosis or the like. In such an image recording apparatus, unexposed photographic films, which are stacked in a magazine, are taken out by a sheet feed mechanism, and then transported to an exposure position by a sheet transporting mechanism.

Since such unexposed photographic films are required to be fed and exposed one by one, the sheet feed mechanism has a device for imparting swinging action to each film, so that a plurality of films can be partly prevented from sticking to each other and being fed together from the magazine.

The sheet feed mechanism typically comprises a suction cup for sucking or attracting a photographic film under suction. Conventional suction cups, however, are incapable of reliably preventing plural films from sticking together even when a swinging action is imparted to the films.

Japanese Laid-Open Utility Model Publication No. 2(1990)-34534, which was filed prior to the priority date of the present application, discloses a suction mechanism capable of sucking and feeding sheet-like members such as flexible metal sheets for packaging IC or LSI thereon, one by one, even if no swinging action is given to the sheet-like members. FIG. 1 of the accompanying drawings shows the disclosed suction mechanism. As shown in FIG. 1, the suction mechanism comprises a suction member 6 having a suction surface 4 facing a stack of sheet-like members 2, the suction surface 4 being curved as a wavy surface. When the uppermost sheet-like member 2 is held closely against the wavy suction surface 4, the next lower sheet-like member 2 is separated from the uppermost one.

However, the suction surface 4 of the suction member 6 shown in FIG. 1 does not have a flexible suction skirt, so the sheet-like member 2 cannot reliably be picked up.

SUMMARY OF THE INVENTION

It is an object of the present invention to provide a suction cup for a sheet feed mechanism, wherein the suction cup comprises a peripheral wall with wavy edges, and a flexible skirt attached to the wavy edges of the peripheral wall, the flexible skirt being pressable against the uppermost one of stacked sheet-like members, so that only the uppermost sheet-like member can reliably be attracted and fed without any swinging or flying action given to the same.

According to the present invention, there is provided a suction cup for a sheet feed mechanism, wherein the suction cup comprises a peripheral wall with wavy edges and a flexible skirt attached to the wavy edges of the peripheral wall, the flexible skirt being pressable against the uppermost one of stacked sheet-like members.

According to the present invention, there is further provided a suction cup for a sheet feed mechanism, wherein the suction cup comprises a base body which includes a panel member having an opening extending from one surface to another surface of the panel member, said opening being adapted to be connected to a vacuum source, a peripheral wall, joined to said other surface of the panel member and having wavy edges and a flexible suction skirt attached to and extending from said wavy edges of said peripheral wall, said flexible suction skirt being pressable against a sheet-like member.

According to the present invention, there is provided a suction cup for a sheet feed mechanism, comprising a base body including a panel having an opening defined therein and extending from one surface to another surface thereof, the opening being adapted to be connected to a vacuum source, the base body further including a peripheral wall joined to the other surface of the panel and having wavy edges, and a flexible suction skirt attached to and extending from the wavy edges of the peripheral wall, the flexible suction skirt being pressable against a sheet-like member.

The peripheral wall has an elongate rectangular shape including longitudinal edges as the wavy edges.

The flexible suction skirt has an elongate rectangular edge pressable against the sheet-like member, the elongate rectangular edge corresponding in shape to the peripheral wall and having longitudinal and transverse edge segments with corners defined therein.

The sheet-like member comprises a film.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
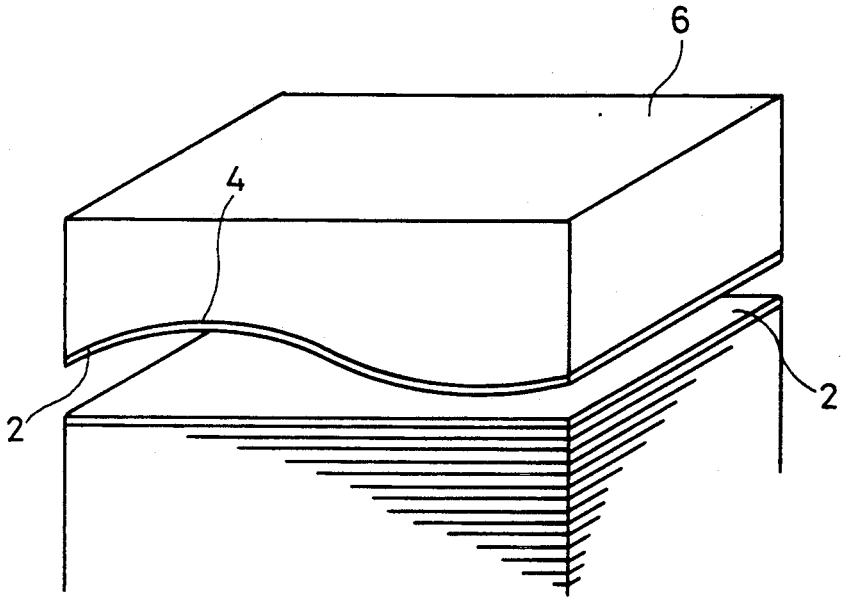
FIG. 1 is a perspective view of a conventional suction mechanism.
Figure 2:
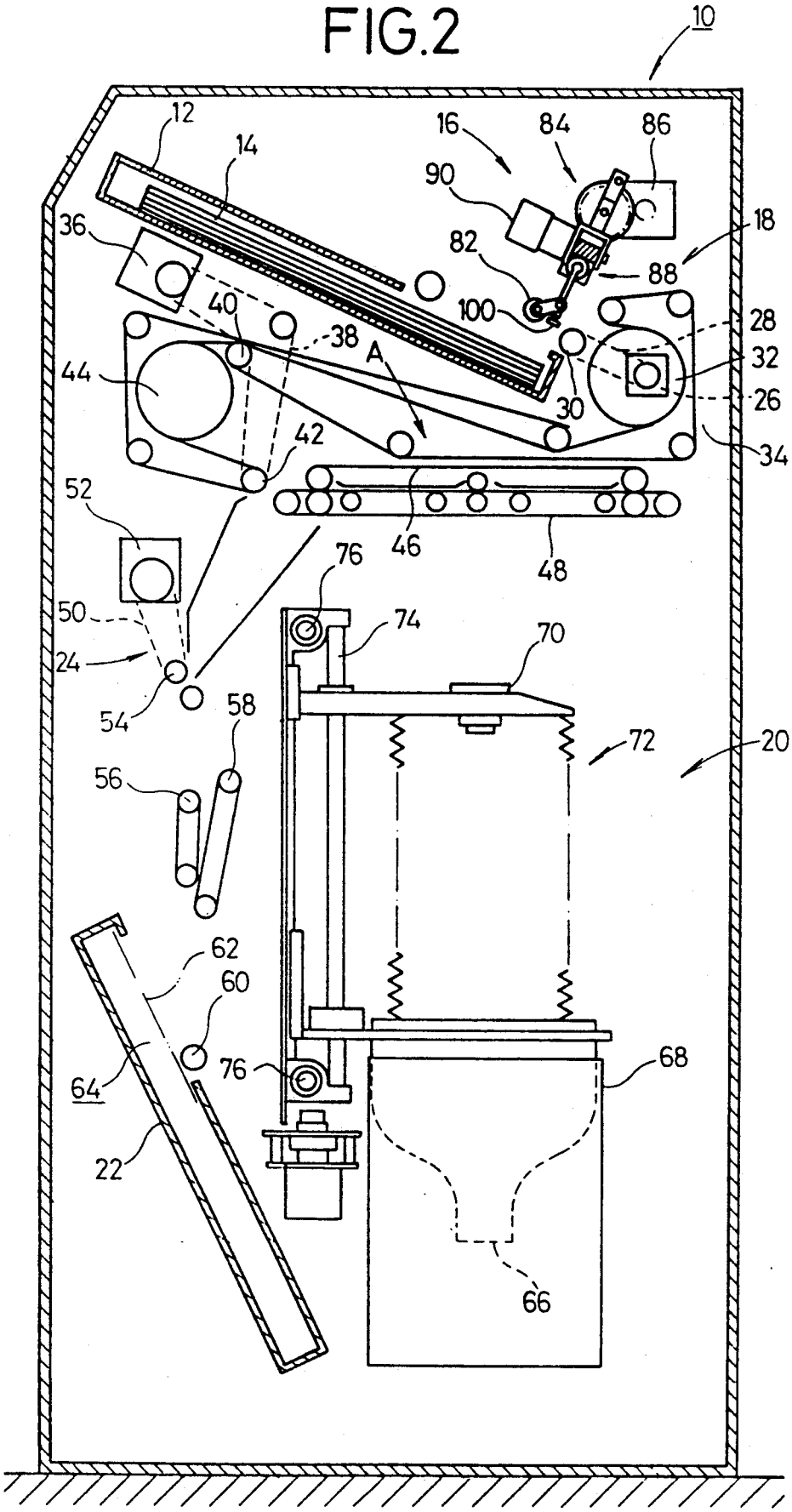
FIG. 2 is a schematic vertical cross-sectional view of an image recording apparatus which incorporates a suction cup for a sheet feed mechanism according to the present invention.

FIG. 2 shows an image recording apparatus which incorporates therein a suction cup for a sheet feed mechanism according to the present invention. The image recording apparatus, generally denoted at 10, comprises a sheet feed mechanism 16 for taking out stacked unexposed photographic films, one by one, from a magazine 12, a sheet transporting mechanism 18 for transporting an unexposed photographic film 14, which has been taken out from the magazine 12, to an exposure position A, an exposure mechanism 20 disposed below the exposure position A, for exposing the photographic film 14 to an image, and another sheet transporting mechanism 24 for transporting an exposed photographic film 14 to a magazine 22, in which exposed photographic films 14 are stacked.

In the sheet transporting mechanism 18, an unexposed photographic film 14 is transported past a fixed roller 30 which is rotated by a motor 26 through a belt 28, and then transported while being reversed by a drum 32 and a belt 34 held in contact therewith. Then, the photographic film 14 is transported along the outer circumferential surface of a drum 44 by drive rollers 40, 42 which are rotated by a motor 36 through a belt 38. At this time, the photographic film 14 is reversed again. The photographic film 14 thus reversed again is transported into the exposure position A.

In the exposure position A, there are disposed a first horizontal belt conveyor 46 and a second horizontal belt conveyor 48 which are held closely together. The photographic film 14 is positioned in the exposure position A by the belt conveyors 46, 48 when they are rotated.

After the photographic film 14 has been exposed by the exposure mechanism 20, the belt conveyors 46, 48 are rotated in the opposite direction to direct the photographic film 14 toward the sheet transporting mechanism 24. The photographic film 14 is transported by a drive roller 54 rotated by a motor 52 through a belt 50 and belt conveyors 56, 58 which are rotated by a motor (not shown), and stored in the magazine 22. The magazine 22 has a shutter 62 which has a rack held in mesh with a pinion 60. The shutter 62 opens and closes an opening 64 defined in the magazine 22.

The exposure mechanism 20 has an image display device 68 for displaying image information on a CRT display unit 66, and an optical system 72 for projecting the image displayed on the CRT display unit 66 onto the photographic film 14 through a focusing lens 70. The image display device 68 and the optical system 72 are vertically movable along a guide rail 74, and the image display device 68, the optical system 72, and the guide rail 74 are movable along guide rails 76 in a direction normal to the sheet of FIG. 2. Therefore, the image display device 68 and the optical system 72 are movable into an optimum position required for exposure of the photographic film 14 when the latter is to be exposed to a desired image.

The sheet feed mechanism 16, the sheet transporting mechanisms 18, 24, and the exposure mechanism 20 are controlled in their operation by a controller which is mainly composed of a microcomputer (not shown).

The sheet feed mechanism 16 comprises a suction cup 100 for attracting or sucking a photographic film 14 and taking out the same from the magazine 12, a movable roller 82 movable toward and away from the fixed roller 30 of the sheet transporting mechanism 18, a crank mechanism 84 for moving the suction cup 100 and the movable roller 82 into the magazine 12, and a pulse motor 86 for actuating the crank mechanism 84.

The sheet feed mechanism 16 can feed an unexposed photographic film 14 without imparting a swinging or flying action to the film 14. However, a swinging or flying action may be given to an unexposed photographic film 14 by a swinging mechanism 88 which swings the suction cup 100 and a pulse motor 90 which actuates the swinging mechanism 88.

Figure 3:
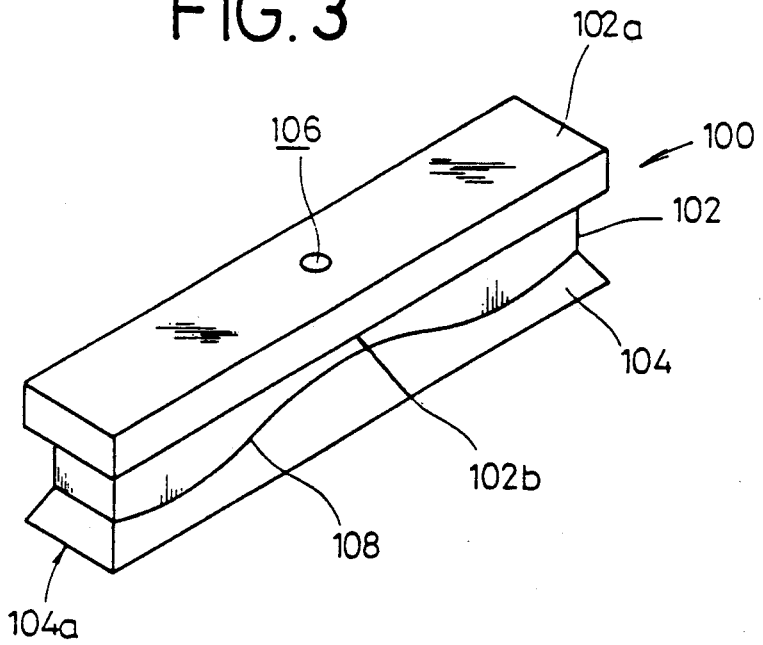
FIG. 3 is a perspective view of a suction cup according to a preferred embodiment of the present invention.

As shown in FIG. 3, the suction cup 100 comprises an elongate rigid base body 102 substantially in the form of a rectangular parallelepiped, and a flexible suction skirt 104 attached to the base body 102.

Figure 4:
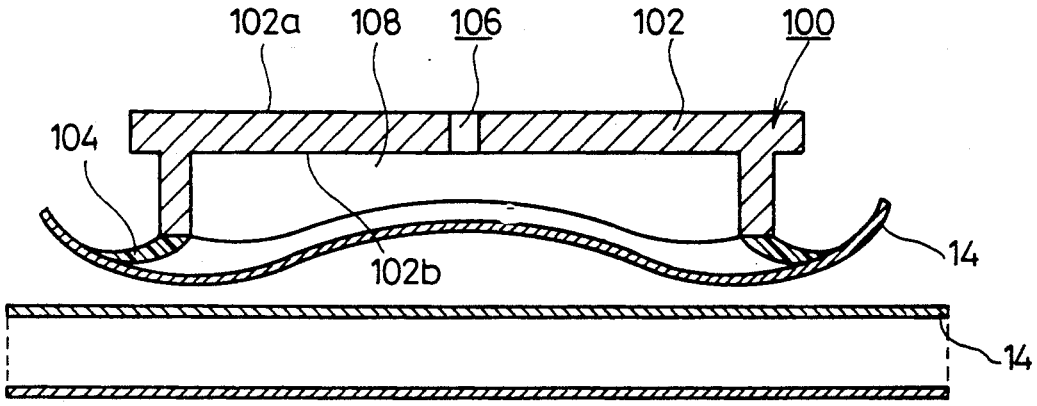
FIG. 4 is a longitudinal cross-sectional view of the suction cup shown in FIG. 3, the view being illustrative of the manner in which the suction cup acts on a stack of sheet-like members.

More specifically, the base body 102 has an opening or hole 106 extending from the upper surface **102*a* to the lower surface 102*b* of the upper member of the base body 102 (FIG. 4). The hole 106 is connected to a vacuum source (not shown) for developing a vacuum to draw air from the suction cup 100. The base body 102 includes a rectangular peripheral wall 108 integral with the lower surface 102*b* of the upper member and having opposite wavy or corrugated longitudinal edges facing downwardly (FIGS. 3 and 4) and spaced transversely from each other. The suction skirt 104 extends from the peripheral wall 108 downwardly and outwardly. The suction cup 100 is made of natural rubber, urethane rubber, neoprene, silicone rubber, or the like. The base body 102 has a thickness large enough not to be deformed while the suction cup 100 is sucking or attracting a photographic film 14. The suction skirt 104 is thin enough to be elastically deformable into a wavy shape corresponding to the wavy edges of the peripheral wall 108. The thickness of the base body 102 may be about 5 mm, and the thickness of the suction skirt 104 may be about 1 mm. The base body 102 may be made of a metal such as aluminum, stainless steel, or the like, or a plastic material such as vinyl chloride, acrylic resin, or the like, and the suction skirt 104, which may be made of natural rubber, urethane rubber, neoprene, silicone rubber, or the like, may be bonded to the base body 102** by an adhesive or the like.

The suction skirt 104 has a lower peripheral edge **104*a* having an elongate rectangular shape corresponding in shape to the peripheral wall 108. When a sucking action developed in the suction cup 100 through the hole 106 by a suction pump (not shown) of the vacuum source is ceased after a photographic film 14 attracted to the suction cup 100 has been taken out of the magazine 12, ambient air is introduced into the suction cup 100 from the four corners between longitudinal and transverse edge segments of the rectangular edge 104*a*. As a result, the photographic film 14 is easily and reliably released from the suction cup 100**.

The suction cup 100 thus constructed operates as follows: When the suction cup 100 is pressed against the uppermost one of stacked photographic films 14 in the magazine 12, the flexible suction skirt 104 is elastically deformed into a shape corresponding to the wavy edges of the peripheral wall 108 of the base body 102, as shown in FIG. 4. Therefore, the uppermost photographic film 14 is also deformed into a wavy shape and pressed against the suction skirt 104.

Accordingly, air flows in between the photographic film 14 pressed against the suction skirt 104 and the next lower photographic film 14. Only the uppermost photographic film 14 can therefore reliably be attracted under suction and taken out of the magazine 12.

The wavy edge configuration of the peripheral wall 108 may extend along the entire edges of the peripheral wall 108, rather than along the opposite longitudinal edges thereof and shown in FIGS. 3 and 4.

As described above, the suction cup for the sheet feed mechanism according to the present invention has the flexible suction skirt extending from the peripheral wall of the base body, the peripheral wall having wavy or corrugated wedges. When the suction skirt is pressed against an uppermost sheet-like member, the suction skirt is elastically deformed into a shape corresponding to the wavy edge configuration of the peripheral wall.

As a result, air flows in between the uppermost sheet-like member against which the suction skirt is pressed and another sheet-like member that is positioned directly below the uppermost sheet-like member, reliably separating these sheet-like members from each other.

Therefore, only the uppermost sheet-like member can reliably be attracted to the suction cup and taken out from the stack of sheet-like members.

Since the sheet-like member is deformed into a wavy shape corresponding to the elastically deformed suction skirt, any mechanism for imparting a swinging or flying action to the sheet-like member when it is attracted and fed by the suction mechanism is superfluous.

Although a certain preferred embodiment has been shown and described, it should be understood that many changes and modifications may be made therein without departing from the scope of the appended claims.

What is claimed is:

1. A suction cup for a sheet feed mechanism adapted for use with stacked sheet-like members, comprising:

a peripheral wall with wavy edges; and a flexible skirt attached to the wavy edges of the peripheral wall and extending downwardly and outwardly thereof, said flexible skirt being pressable against the uppermost one of said stacked sheet-like members to be elastically deformed into a shape corresponding to said wavy edges of said peripheral wall to separate said uppermost one of said stacked sheet-like members from a subsequent sheet-like member.

2. A suction cup adapted for use with a sheet-like member, comprising:

a base body having first and second surfaces and including a panel member having an opening extending from said first surface to said second surface of the panel member, and a peripheral wall joined to said second surface of the panel member and having wavy edges, said opening being adapted to be connected to a vacuum source; and a flexible suction skirt attached to and extending outwardly and downwardly from said wavy edges of said peripheral wall, said flexible suction skirt being pressable against said sheet-like member to be elastically deformed into a shape corresponding to said wavy edges of said peripheral wall.

3. A suction cup for a sheet feed mechanism adapted for use with stacked sheet-like members, comprising:

a peripheral wall with wavy edges; and a flexible skirt attached to the wavy edges of the peripheral wall and extending downwardly and outwardly thereof, said flexible skirt being pressable against the uppermost one of said stacked sheet-like members to separate said uppermost one of said stacked sheet-like members from a subsequent sheet-like member, wherein said peripheral wall has an elongate rectangular shape including longitudinal edges comprising said wavy edges.

4. A suction cup for a sheet feed mechanism adapted for use with stacked sheet-like members, comprising:

a peripheral wall with wavy edges; and a flexible skirt attached to the wavy edges of the peripheral wall and extending downwardly and outwardly thereof, said flexible skirt being pressable against the uppermost one of said stacked sheet-like members to separate said uppermost one of said stacked sheet-like members from a subsequent sheet-like member, wherein said flexible suction skirt has an elongate rectangular edge pressable against the sheet-like member, said elongate rectangular edge corresponding in shape to said peripheral wall and having longitudinal and transverse edge segments with corners defined therein.

5. A suction cup according to claim 1, wherein said sheet-like member comprises a film.

6. A suction cup adapted for use with a sheet-like member, comprising:

a base body having first and second surfaces and including a panel member having an opening extending from said first surface to said second surface of the panel member, and a peripheral wall joined to said second surface of the panel member and having wavy edges, said opening being adapted to be connected to a vacuum source; and a flexible suction skirt attached to and extending outwardly and downwardly from said wavy edges of said peripheral wall, said flexible suction skirt being pressable against said sheet-like member, wherein said peripheral wall has an elongate rectangular shape including longitudinal edges comprising said wavy edges.

7. A suction cup adapted for use with a sheet-like member, comprising:

a base body having first and second surfaces and including a panel member having an opening extending from said first surface to said second surface of the panel member, and a peripheral wall joined to said second surface of the panel member and having wavy edges, said opening being adapted to be connected to a vacuum source; and a flexible suction skirt attached to and extending outwardly and downwardly from said wavy edges of said peripheral wall, said flexible suction skirt being pressable against said sheet-like member, wherein said flexible suction skirt has an elongate rectangular edge pressable against the sheet-like member, said elongate rectangular edge corresponding in shape to said peripheral wall and having longitudinal and transverse edge segments with corners defined therein.

8. A suction cup according to claim 2, wherein said sheet-like member comprises a film.

9. A suction cup according to claim 3, wherein said sheet-like member comprises a film.

10. A suction cup according to claim 4, wherein said sheet-like member comprises a film.

11. A suction cup according to claim 6, wherein said sheet-like member comprises a film.

12. A suction cup according to claim 7, wherein said sheet-like member comprises a film.

* * * * *